US011585221B1

(12) United States Patent
Buchanan et al.

(10) Patent No.: US 11,585,221 B1
(45) Date of Patent: Feb. 21, 2023

(54) VANE DRIVE ROTARY COMBUSTION ENGINE

(71) Applicants: William Gregory Buchanan, King George, VA (US); Eric A. Wheater, King George, VA (US); Vincent J. Vendetti, King George, VA (US)

(72) Inventors: William Gregory Buchanan, King George, VA (US); Eric A. Wheater, King George, VA (US); Vincent J. Vendetti, King George, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 242 days.

(21) Appl. No.: 16/840,186

(22) Filed: Apr. 3, 2020

Related U.S. Application Data

(63) Continuation-in-part of application No. 16/668,530, filed on Oct. 30, 2019, now Pat. No. 11,143,098.

(60) Provisional application No. 62/913,364, filed on Oct. 10, 2019, provisional application No. 62/853,223, filed on May 28, 2019, provisional application No. 62/828,595, filed on Apr. 3, 2019.

(51) Int. Cl.

| | |
|---|---|
| ***F02B 53/00*** | (2006.01) |
| ***F02B 53/04*** | (2006.01) |
| ***F02B 53/06*** | (2006.01) |
| ***F02B 55/00*** | (2006.01) |
| ***F02B 55/02*** | (2006.01) |
| ***F02B 55/08*** | (2006.01) |
| ***F02B 55/14*** | (2006.01) |
| ***F01C 1/22*** | (2006.01) |
| ***F01C 1/344*** | (2006.01) |
| ***F01C 1/356*** | (2006.01) |

(52) U.S. Cl.
CPC ..... *F01C 1/344* (2013.01); *F01C 1/22* (2013.01); *F01C 1/3568* (2013.01); *F02B 53/00* (2013.01); *F02B 53/04* (2013.01); *F02B 53/06* (2013.01); *F02B 55/00* (2013.01); *F02B 55/02* (2013.01); *F02B 55/08* (2013.01); *F02B 55/14* (2013.01)

(58) Field of Classification Search
CPC ..... F02B 53/00; F02B 53/04; F02B 53/06; F02B 55/00; F02B 55/02; F02B 55/08; F02B 55/14; F01C 1/22; F01C 1/344; F01C 1/13568
See application file for complete search history.

(56) References Cited

U.S. PATENT DOCUMENTS 1,028,316 A 6/1912 Allyn
1,701,534 A 2/1929 Knopp
(Continued)

*Primary Examiner* — Audrey B. Walter
(74) *Attorney, Agent, or Firm* — Gerhard W. Thielman

(57) ABSTRACT

A rotary engine is provided for providing torque. The engine includes a housing, a stator, a crank shaft, a rotor and a pair of vanes. The housing has an inner wall with an elliptical profile with major and minor axes. The stator has an outer wall and a double ellipsoid profile corresponding to the major and minor axes. The crank shaft is disposed at a junction of the major and minor axes, rotating about a spin axis orthogonal to the profiles. The rotor has an annular circular profile disposed between the inner and outer walls. The rotor turns on the crank shaft. The vanes radially slide within the rotor as the crank shaft rotates and as the vanes turn within the inner and outer walls.

4 Claims, 2 Drawing Sheets

(56) References Cited

U.S. PATENT DOCUMENTS

| | | | | | |
|---|---|---|---|---|---|
| 1,999,187 | A | * | 4/1935 | Gerlat | F02B 53/00 123/213 |
| 2,988,008 | A | | 6/1961 | Wankel | 303/121 |
| 3,682,143 | A | * | 8/1972 | Leas | F02B 53/00 123/240 |
| 3,902,829 | A | * | 9/1975 | Burrowes | F01D 5/30 418/111 |
| 4,018,191 | A | * | 4/1977 | Lloyd | F01C 20/22 123/243 |
| 5,277,158 | A | * | 1/1994 | Pangman | F16N 13/20 123/243 |
| 5,305,721 | A | | 4/1994 | Burtis | 123/205 |
| 5,415,141 | A | * | 5/1995 | McCann | F02B 55/00 123/243 |
| 5,711,268 | A | * | 1/1998 | Holdampf | F01C 1/3446 123/243 |
| 8,936,004 | B1 | | 1/2015 | Buchanan | 123/228 |

* cited by examiner

VANE DRIVE ROTARY COMBUSTION ENGINE

CROSS REFERENCE TO RELATED APPLICATION

Pursuant to 35 U.S.C. § 119, the benefit of priority from provisional applications 62/828,595, 62/853,223 and 62/913,364, with respective filing dates of Apr. 3, 2019, May 28, 2019 and Oct. 10, 2019, is claimed for this non-provisional application. The invention is a Continuation-in-Part, claims priority to and incorporates by reference in its entirety U.S. patent application Ser. No. 16/668,530 filed Oct. 30, 2019 and assigned Navy Case 105803.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to rotary engines. In particular, the invention relates to rotary engines with simple geometries.

Rotary internal combustion engines have been developed for decades. These include U.S. Pat. No. 1,028,316 to Allyn, U.S. Pat. No. 1,701,534 to Knopp, U.S. Pat. No. 2,988,008 to Wankel (the best known), and U.S. Pat. No. 5,305,721 to Burris. Another more recent is U.S. Pat. No. 8,936,004 to Buchanan with a modified Otto cycle (under tradename "EPIC") as Navy Case 100714.

SUMMARY

Conventional rotary engines yield disadvantages addressed by various exemplary embodiments of the present invention. In particular, various exemplary embodiments provide a rotary engine for providing torque via the EPIC cycle. The engine includes a housing, a stator, a crank shaft, a rotor and a pair of vanes. The housing has an inner wall with an elliptical profile with major and minor axes. The stator has an outer wall and a double ellipsoid profile corresponding to the major and minor axes.

The crank shaft is disposed at a junction of the major and minor axes, rotating about a spin axis orthogonal to the profiles. The rotor has an annular circular profile disposed between the inner and outer walls. The rotor turns on the crank shaft. The vanes radially slide within the rotor as the crank shaft rotates and as the vanes turn within the inner and outer walls.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in inches (in), mass in pounds-mass ($lb_m$), time in seconds (s) and angles in degrees.

Exemplary embodiments describe a family of rotary engines that employ an Exhaust Power Intake Compression (EPIC) stroke cycle via a valve-operation configuration. This EPIC cycle supports the rapid movement of compressed fuel-air mixture from the front of a piston-like lobe feature to the rear of piston-like lobe feature such that the movement of a rotor is continuous and circular about the crank shaft (rather than reciprocating or otherwise moving in an oscillatory direction).

Exemplary embodiments provide a vane configuration of the EPIC cycle engine with a two-cylinder, four-stroke example to provide torque to a crank shaft. The rotary engine generates power by spinning a rotor inside an engine housing. The housing is closed by two covers that are bolted to the housing (not shown). There are exhaust and intake ports through the engine housing are opened and closed via the rotary wall valve and rotor, respectively. Not shown are insertions and routings for ignition, electrical, fuel, cooling, and lubrication systems in the housing, cover plates, and/or wall valve and rotor.

Figure 1:
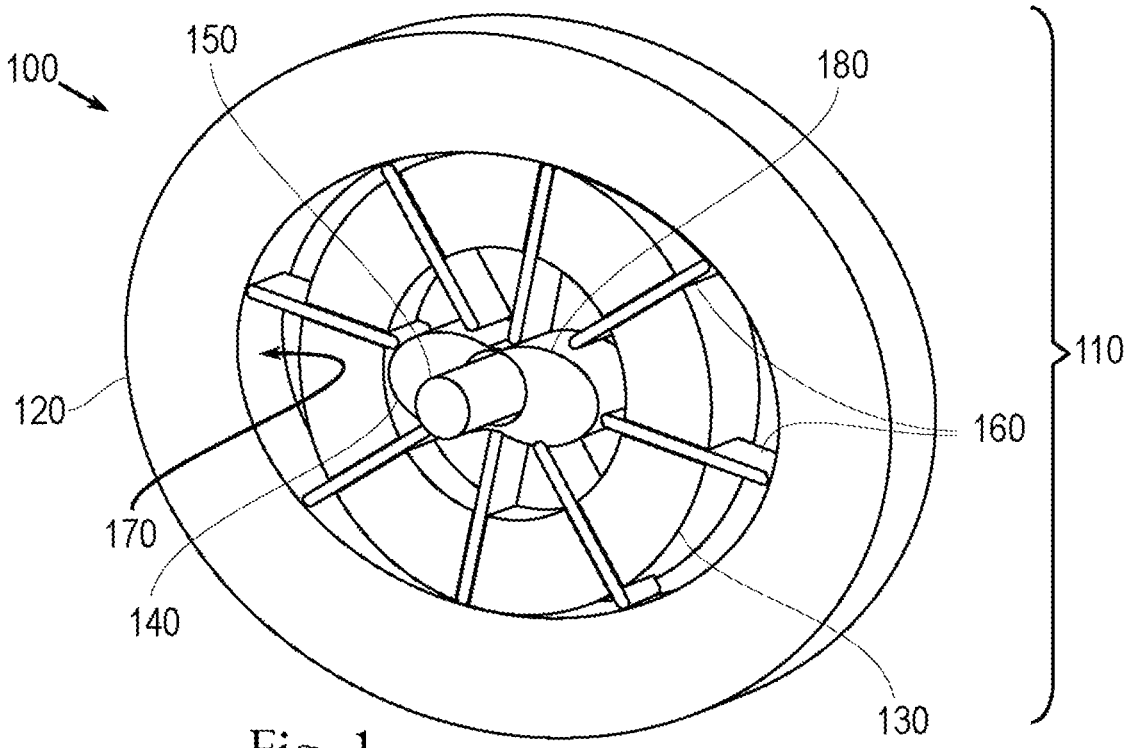
FIG. 1 is an elevation view of an exemplary bilateral rotary engine.

FIG. 1 shows an isometric view 100 of an exemplary vane driven rotary engine 110 having bilateral symmetry. The engine 110 includes an annular elliptical extruded housing 120, a cylindrical drum rotor 130 and a double-ellipsoid stator 140, all having substantially the same thickness with their profiles. The housing 120 and stator 140 both share major and minor axes.

The rotor 130 turns on a crank shaft 150 that rotates about an axis orthogonal to the major and minor axes at their intersection, effectively perpendicular to the profiles. The stator 140 can be connected to and be an integral part of the housing 120. The rotor 130 has an interior circular region in which the stator 140 resides. The stator 140 surrounds but does not engage the shaft 150. A pair of radially extending vanes 160 are angularly disposed around the rotor 130. These vanes 160 radially slide within the rotor 130 while the shaft rotates 150.

The housing 120 includes an inner wall 170, while the stator 140 includes an outer wall 180. These walls 170 and 180 constrain the vanes 160 as they turn with the rotor 130. The vanes 160 shift radially outward and inward as the rotor 130 turns. The vanes 160 are depicted around the housing 120, but typically only a pair such vanes 160 disposed on opposing sides of the rotor 130 represent a typical configuration. The housing 120 has an elliptical profile with the rotor 130 having a circular profile. Alternative embodiments can be designed with these profiles reversed. The crank shaft 150 protrudes axially (perpendicular to the profiles). A hollow-shaft rotor is also possible.

The engine 110 can be scaled, but a typical length dimension of the housing 120 would be on the order of twelve inches. Thickness of the housing 120 and rotor 130 can vary depending on design with roughly one inch being depicted in view 100. Composed substantially of a steel alloy, the engine for such dimensions would have a mass on the order of 20 $lb_m$.

Figure 2:
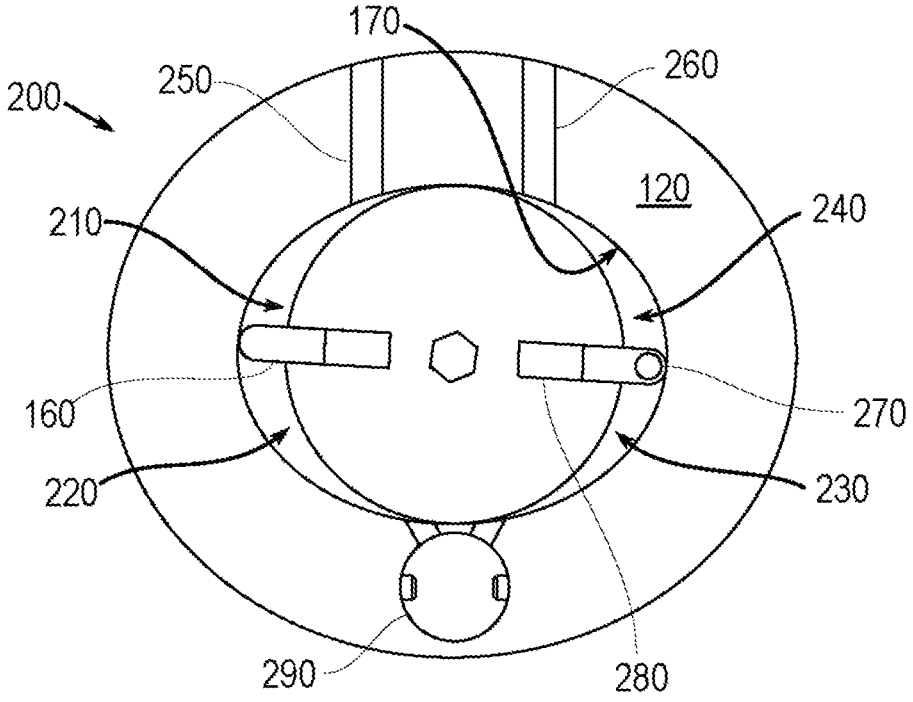
FIG. 2 is an elevation view of the engine.

FIG. 2 shows an elevation view 200 of the exemplary vane driven rotary engine 110. The vanes divide the engine 110 into four chambers: inlet 210, compression 220, power 230 and exhaust 240. The housing 120 includes an inlet port 250 and an exhaust port 260. One vane has a reference mark 270 enabling visual tracing of the rotor 130. As the vanes 160 shift radially while following the rotor's turning, a profile window 280 between the stator's outer wall 180 and the vane 160 expands and contracts. The housing 120 includes a compression tunnel 290 that operates to transfer compressed gasses from the front of a vane 160 to its rear, enabling combustion to continue as the vanes 160 shift radially.

Figure 3:
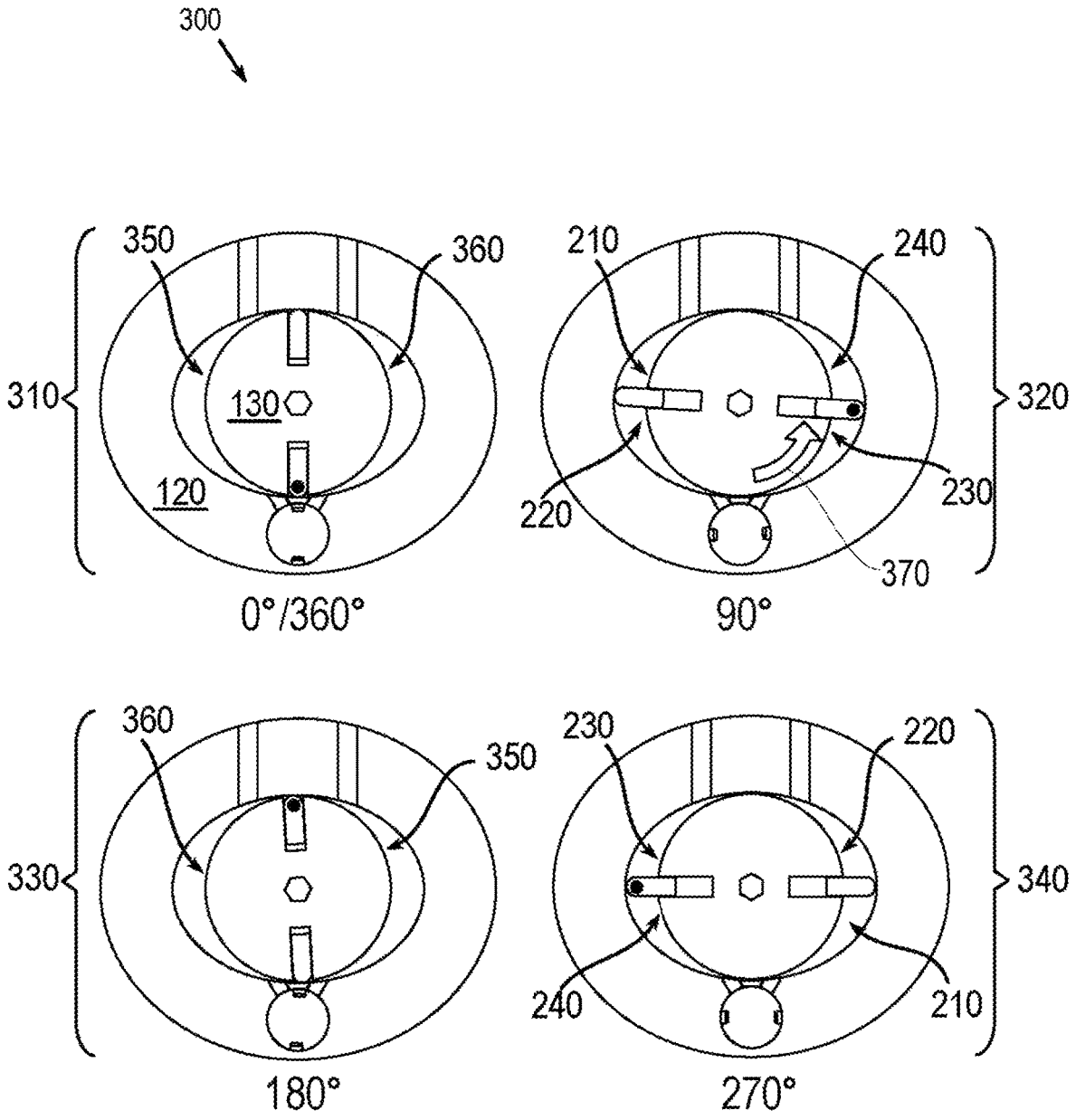
FIG. 3 is an elevation view of the engine.

FIG. 3 shows an elevation view 300 of four orientations as 310, 320, 330 and 340 of the rotor 130 and the vanes 160 to denote strokes of the EPIC cycle. Position 310 illustrates the engine 110 at 0° (and cycle return at 360°). The rotor 130 subdivides the internal volume within the inner wall 270 as left and right crescents 350 and 360. The vanes 160 are disposed at the perigee of the inner wall 170 and the mark 270 at the bottom.

Position 320 illustrates the engine 110 at 90° having rotated anti-clockwise 370 in view 300, although the shaft 150 and rotor 130 can turn in either direction. The vanes 160 are disposed at the apogee of the inner wall 170 and the mark 270 is positioned on the right side. The vanes 160 have extended so as to subdivide the internal volume between the rotor 130 and the housing 120 into half-crescent inlet 210, compression 220, power 230 and exhaust 240 stroke chambers. Position 330 illustrates the engine 110 at 180°. The vanes 160 are disposed again at the perigee of the inner wall 170 with the mark 270 positioned on the top and left and right volumes reversed. Position 340 illustrates the engine 110 at 270°. The vanes 160 are disposed at the apogee of the inner wall 170 with the mark 270 on the left. The half-crescent volumes 210, 220, 230 and 240 switch positions along their opposite diagonals.

Within the housing 120 are a rotor 140 with two vanes 160 (acting as movable wall valves or pistons), two stationary walls 170 and 180, and compression tunnel 290 in the housing 120 or rotor 130. The engine 110 forms a unique four-stroke engine 110 with intake 210, compression 220, power 230 and exhaust 240. The rotor 130 spins upon igniting the compressed fuel-air mixture, and the resulting combustion forces drive the shaft 150 anti-clockwise 270 in a power-stroke 230. Exhaust 240, intake 210 and compression 220 occur in similar manner shown in view 300. At all conditions, the edges of the vanes 160 and the curves of the walls 170 and 180 remain in contact as required to maintain sealing as the rotor 130 spins.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A rotary combustion engine for providing torque, said engine comprising:

a housing having an inner wall with an elliptical profile with major and minor axes;

a stator having an outer wall and a double ellipsoid profile corresponding to said major and minor axes;

a crank shaft disposed at a junction of said major and minor axes, rotating about a spin axis orthogonal to said profiles;

a rotor having an annular circular profile disposed between said inner and outer walls, said rotor rotating on said crank shaft; and a pair of vanes that radially slide within said rotor as said crank shaft rotates and as said vanes turn within said inner and outer walls.

2. The engine according to claim 1, wherein said housing includes inlet and exhaust ports that straddle said minor axis on one side of said major axis.

3. The engine according to claim 1, wherein said housing and said stator integrally connect together.

4. The engine according to claim 1, further including a compression tunnel that transfers compressed gasses along a vane.

* * * * *